United States Patent [19]

Fox

[11] 4,188,031

[45] Feb. 12, 1980

[54] MULTISPORT PRACTICE DEVICE

[76] Inventor: Robert Z. Fox, 5004 Valerie Drive, Crystal Lake, Ill. 60014

[21] Appl. No.: 954,873

[22] Filed: Oct. 26, 1978

[51] Int. Cl.[2] ..... A63B 69/40

[52] U.S. Cl. ..... 273/26 A; 273/354; 273/402; 273/410

[58] Field of Search ..... 273/26 A, 102 R, 102 S, 273/55 B, 127 R, 29 A, 105.6, 181 A, 102.14, 105; 272/101, 102, 103, 104

[56] References Cited

U.S. PATENT DOCUMENTS

| | | | |
|---|---|---|---|
| 708,569 | 9/1902 | Manley | 273/26 A |
| 1,142,184 | 6/1915 | Lawrence | 273/26 A |
| 1,592,005 | 7/1926 | Rovane | 273/26 A |
| 2,126,102 | 8/1938 | Fowler | 273/26 A |
| 2,335,393 | 11/1943 | Bakanouski et al. | 273/105.6 |
| 2,895,737 | 7/1959 | Blees | 273/26 A |
| 3,197,208 | 7/1965 | Makar | 273/181 A |
| 3,312,467 | 4/1967 | Dawson | 273/26 A |
| 3,583,703 | 6/1971 | Brown | 273/26 A |
| 3,929,334 | 12/1975 | Magazzu | 273/26 A |
| 3,997,158 | 12/1976 | Britton | 273/26 A |
| 4,068,846 | 1/1978 | Forrest | 273/55 B |

*Primary Examiner*—Richard C. Pinkham
*Assistant Examiner*—Theatrice Brown
*Attorney, Agent, or Firm*—Vogel, Dithmar, Stotland, Stratman & Levy

[57] ABSTRACT

A multisport practice device for defining a target for and arresting the flight of a ball or other projectile includes a base supporting a pair of laterally spaced-apart upright posts carrying a net closing the space therebetween. Adjustable crossbar members carry eyelet screws for removably hanging the crossbars from vertically spaced-apart hook screws on the upright posts to define a variable-height target area.

9 Claims, 4 Drawing Figures

MULTISPORT PRACTICE DEVICE

BACKGROUND OF THE INVENTION

The present invention relates to a target-defining practice device for practicing the throwing, kicking, hitting or the like of various projectiles used in sporting events.

Such practice devices are generally known in the art and typically include a framework on which is supported means such as a net or the like for intercepting and arresting the flight of a projectile, and means for defining a target area. Most such devices are designed for one particular sport such as baseball, football, golf or the like. While some of these prior devices include means for varying the size of the target area, the devices are generally complicated and cumbersome to operate. Furthermore, in many such devices the horizontal boundaries of the target area, as well as the projectile-arresting means, are permanently mounted on the structure, resulting in difficulty of adjustment, replacement or repair.

SUMMARY OF THE INVENTION

The present invention relates to an improved practice device which overcomes the disadvantages and limitations of prior art devices.

More particularly, it is an object of the present invention to provide a multisport practice device which is readily adaptable for use in practicing any of a wide variety of sports including baseball, football, tennis, golf, hockey, or the like.

It is another object of the invention to provide such a practice device which includes means for removably mounting a projectile-arresting net on a support frame.

Still another object of the invention is to provide a device of the character described, which includes unique means for removably mounting crossbar members on a pair of upright posts so that the crossbar members can readily be shifted among a plurality of positions for varying a target area defined therebetween.

Further features of the invention pertain to the particular arrangement of the parts of the practice device whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figure 1:
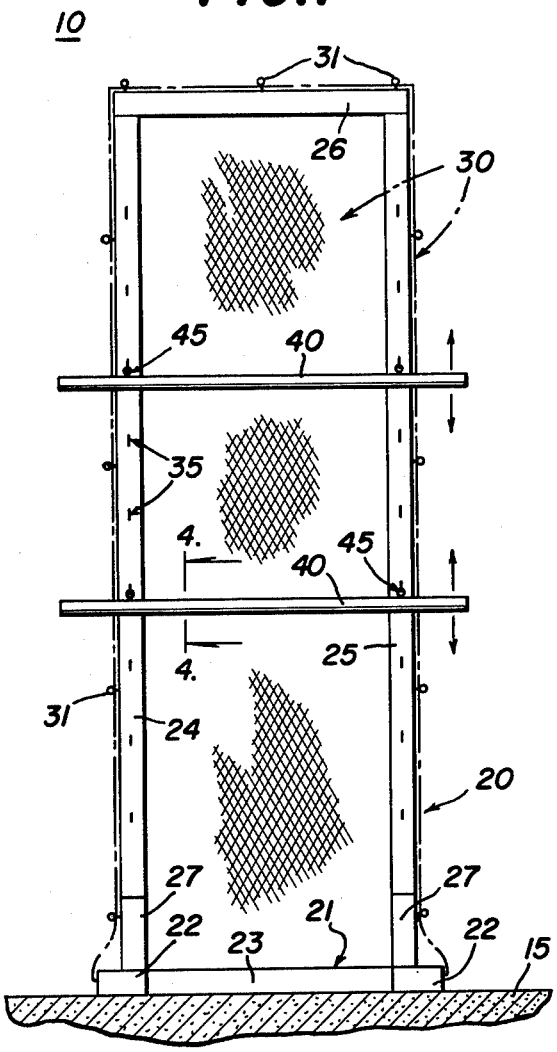
FIG. 1 is a front elevational view of a multisport practice device constructed in accordance with and embodying the features of the present invention.
Figure 2:
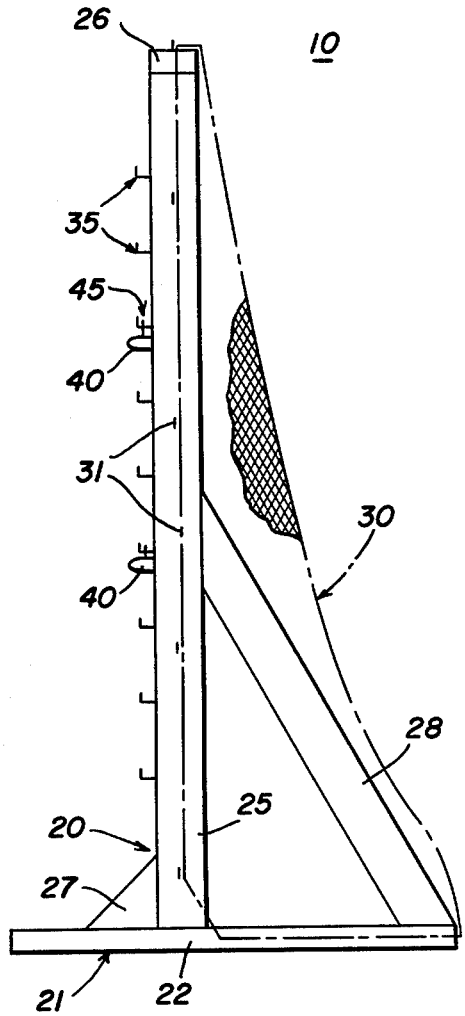
FIG. 2 is a side elevational view of the device of FIG. 1, as viewed from the right-hand side thereof.
Figure 3:
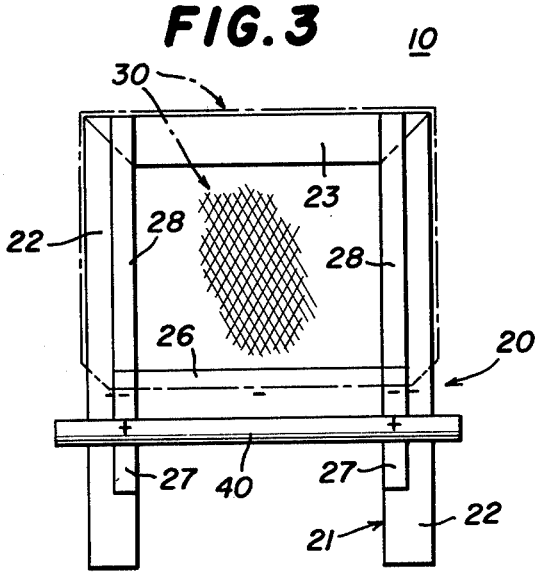
FIG. 3 is a top plan view of the device illustrated in FIGS. 1 and 2.
Figure 4:
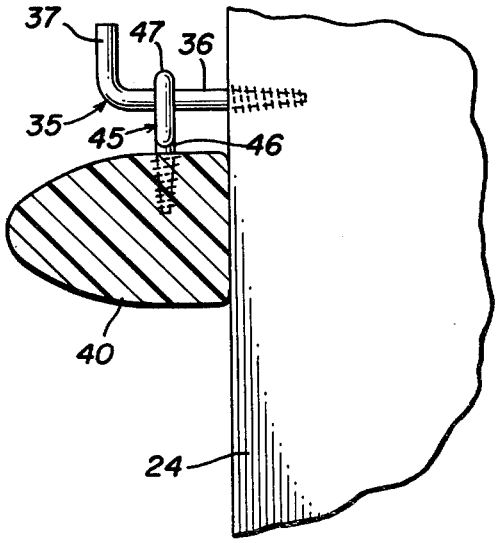
FIG. 4 is an enlarged fragmentary view in vertical section taken along the line 4—4 in FIG. 1.

Referring to FIGS. 1 through 3 of the drawings, there is illustrated a practice device, generally designated by the numeral 10, which is constructed in accordance with and embodies the features of the present invention. The practice device 10 is adapted to be placed upon the floor or ground 15, or other support surface, and includes a frame, generally designated by the numeral 20, which is preferably formed of wood, but which may be formed of any other suitable material such as metal, plastic or the like. The frame 20 includes a generally U-shaped base 21 which includes a pair of laterally spaced-apart parallel side members 22 interconnected at the rear ends thereof by a rear member 23. Respectively fixedly secured to the side members 22 forwardly of the midpoints thereof are two vertically extending support posts 24 and 25, which are interconnected at the upper end thereof by a horizontally extending top bar 26. Support blocks 27 are secured to the bottoms of the support posts 24 and 25 and to the adjacent base side members 22, and two angle braces 28 are respectively secured between the support posts 24 and 25 and the rear ends of the base side members 22, all for stabilizing the frame 20.

A net, generally designated by the numeral 30, is supported on the frame 20. More particularly, a plurality of fastening members such as eyelet screws 31 are longitudinally spaced apart along the outer side edges of the support posts 24 and 25 and the top bar 26, the peripheral edges of the net 30 being removably attached to the eyelet screws 31 so that the net 30 encircles the frame 20 and partially envelopes the support posts 24 and 25 and the top bar 26. Preferably, the net 30 covers the angle braces 28 and extends downwardly around the rear portion of the base 21. The net 30 is of the non-tensioned variety and forms a loose pocket for intercepting and arresting the flight of an associated projectile such as a ball or the like.

Mounted on the front face of each of the support posts 24 and 25 is a plurality of equidistantly vertically spaced-apart hook members 35, each of the hook members 35 having a threaded shank portion 36 threadedly engaged with the associated support post and an upstanding hook end portion 37. The hook members 35 are arranged so that each hook member 35 on one of the support posts is in substantially horizontal alignment with a corresponding hook member 35 on the other support post.

The device 10 also includes two crossbars 40 which may be substantially identical in construction, each of the crossbars 40 having secured thereto respectively adjacent to the opposite ends thereof two eyelet screws 45, each of the eyelet screws 45 having a threaded shank 46 threadedly engaged in the crossbar 40 substantially normal to the longitudinal axis thereof, and an eyelet portion 47, the eyelet portions 47 of the two eyelet screws 45 being substantially coplanar.

It will be appreciated that, in use, the crossbars 40 are hung on the frame 20 by hooking the eyelets 47 of the eylet screws 45 over the hook ends 37 of horizontally-aligned ones of the hook members 35. Thus, it can be appreciated that the crossbars 40 are easily mounted and demounted with respect to the frame 20. Preferably, the crossbars 40 are arranged in vertically spaced-apart relationship on the support posts 24 and 25 for cooperation therewith to define therebetween a rectangular target area.

In using the device 10, a user will attempt to throw or project a ball or other projectile into the target area, the projectile then being trapped by the net 30. For example, the spacing of the crossbars 40 may approximate the vertical strike zone in baseball for practicing pitching accuracy. Preferably, the lateral spacing between the support posts 24 and 25 corresponds to the width of a baseball base so that, with the crossbars 40 removed, the device 10 may be used for practicing accuracy of throwing to a base. It will be understood that the device 10 could also be used for practicing pitching with a batter present, with the horizontal crossbars 40 either in place or removed.

For soccer, the device 10 could be used for practicing kicking accuracy, with the crossbars 40 removed. Likewise, for hockey, the device 10 could be used for practicing shooting accuracy with the crossbars 40 either in place or removed. For football, the device 10 could be used for practicing throwing accuracy with the crossbars 40 in place or removed and, with the crossbars removed, the device 10 could be used for practicing kicking accuracy. For golf, the device 10 could be used as a backstop for practicing driving or other shots and, for tennis, the device 10 can be used as a backstop for practicing serving accuracy.

It is an important feature of the present invention that the arrangement of mounting the net 30 on the eyelet screws 31 affords ease of removal of the net 30 for replacement, repair or the like. Similarly, it is an important advantage of this invention that the hook and eyelet mounting arrangement for the crossbars 40 permits simple and easy mounting and demounting of the crossbars 40 for varying the size of the target area.

In a constructional model of the present invention, the crossbars 40 may be formed of any suitable material such as wood, metal, plastic or the like. But it has been found to be preferable that the crossbars 40 be formed of a high impact-resistant material to avoid breakage resulting from the impact of thrown or struck projectiles. Thus, the crossbars 40 may be formed of a flexible resilient material such as rubber or the like. If desired, the support posts 24 and 25 could also be formed of impact-resistant material and, while the height of the support posts 24 and 25 is preferably about 6 feet, it will be appreciated that they could be any desired height.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A multisport practice device for defining a target for arresting the flight of a ball or other projectile, said device comprising a base, a pair of elongated laterally spaced-apart support posts mounted on said base and extending vertically upwardly therefrom, a net mounted on said support posts and closing the space therebetween for intercepting and arresting the flight of an associated projectile, a plurality of hook members secured to and vertically spaced apart along each of said support posts so that each hook member on one of said support posts is substantially in horizontal alignment with a corresponding hook member on the other support post, and two crossbar members each having two eyelet members secured thereto respectively adjacent to the opposite ends thereof, said eyelet members on each crossbar member being adapted respectively to receive therein associated horizontally-aligned ones of said hook members for adjustably mounting said crossbar members at vertically spaced-apart locations on said support posts to define therebetween a variable target area.

2. The device of claim 1, and further including a plurality of fastening members vertically spaced apart along the outer sides of said support posts for fastening said net thereto.

3. The device of claim 1, and further including a top bar interconnecting said support posts at the upper ends thereof.

4. The device of claim 3, and further including a plurality of fastening members longitudinally spaced apart along said support posts and said top bar for fastening said net thereto, said net substantially closing the area defined by said support posts and said top bar and said base.

5. The device of claim 1, wherein said net is untensioned and defines a loose projectile-receiving pocket.

6. The device of claim 1, wherein each of said crossbar members is formed of an impact-resistant material.

7. The device of claim 1, wherein each of said crossbar members is formed of rubber.

8. The device of claim 1, wherein the lateral spacing between said support posts is substantially equal to the width of a baseball base.

9. The device of claim 1, and further including brace means interconnecting said base and said support posts for stabilizing same.

* * * * *